US009022514B2

(12) United States Patent
Fujisawa

(10) Patent No.: US 9,022,514 B2
(45) Date of Patent: May 5, 2015

(54) PRINTING APPARATUS AND PRINTING METHOD

(71) Applicant: Seiko Epson Corporation, Tokyo (JP)

(72) Inventor: Kazutoshi Fujisawa, Okaya (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/220,469

(22) Filed: Mar. 20, 2014

(65) Prior Publication Data

US 2014/0292877 A1 Oct. 2, 2014

(30) Foreign Application Priority Data

Mar. 28, 2013 (JP) ..... 2013-068277

(51) Int. Cl.

| | |
|---|---|
| ***B41J 29/38*** | (2006.01) |
| ***B41J 11/00*** | (2006.01) |
| *B41M 7/00* | (2006.01) |
| *B41J 3/28* | (2006.01) |

(52) U.S. Cl.

CPC ..... *B41J 11/002* (2013.01); *B41M 7/0081* (2013.01); *B41J 3/28* (2013.01)

(58) Field of Classification Search

CPC ..... B41J 11/42; B41J 29/393; B41J 29/38; B41J 3/60; B41J 11/0095

USPC ..... 347/16, 102

See application file for complete search history.

(56) References Cited

U.S. PATENT DOCUMENTS

| | | | | |
|---|---|---|---|---|
| 2004/0141040 | A1 | 7/2004 | Nakajima | |
| 2010/0239777 | A1 * | 9/2010 | Nakajima et al. | 427/508 |
| 2011/0261131 | A1 * | 10/2011 | Eve et al. | 347/104 |
| 2012/0069082 | A1 * | 3/2012 | Hayata | 347/20 |
| 2012/0120168 | A1 * | 5/2012 | Kachi et al. | 347/102 |

FOREIGN PATENT DOCUMENTS

| | | |
|---|---|---|
| JP | 2004-188891 | 7/2004 |
| JP | 2009-202418 | 9/2009 |
| JP | 2012-101367 | 5/2012 |

* cited by examiner

*Primary Examiner* — Manish S Shah
*Assistant Examiner* — Yaovi Ameh
(74) *Attorney, Agent, or Firm* — Workman Nydegger

(57) ABSTRACT

A printing apparatus including a print head that performs a printing pass that ejects a photocurable liquid onto a printing medium while being displaced in a main scanning direction each time the print head is displaced in a sub-scanning direction by a displacing amount of a sub-scanning operation, a first irradiation unit that follows the print head displaced in the main scanning direction while radiating light onto an area that is larger than the displacing amount of a sub-scanning operation, and a second irradiation unit that irradiates the light towards an area where irradiation of the light has been completed by the first irradiation unit. Furthermore, an integrated quantity of light of the first irradiation unit is reduced and an integrated quantity of light of the second irradiation unit is increased, in accordance with the increase in the set number of printing passes to be carried out.

8 Claims, 11 Drawing Sheets

GLOSSINESS 60

| NUMBER OF PRINTING PASSES | PRELIMINARY CURING UNIT 93 | | | | FULL CURING UNIT 94 | | | | TOTAL INTEGRATED QUANTITY OF LIGHT |
|---|---|---|---|---|---|---|---|---|---|
| | CURRENT | ILLUMINANCE | DUTY RATIO | FIRST INTEGRATED QUANTITY OF LIGHT | CURRENT | ILLUMINANCE | DUTY RATIO | SECOND INTEGRATED QUANTITY OF LIGHT | |
| | mA | mW/cm² | % | mJ/cm² | mA | mW/cm² | % | mJ/cm² | mJ/cm² |
| 4 | 160 | 300 | 51 | 68.0 | 180 | 750 | 85.2 | 142.0 | 210 |
| 6 | 160 | 300 | 30 | 60.0 | 180 | 750 | 60 | 150.0 | 210 |
| 8 | 160 | 300 | 21 | 56.0 | 180 | 750 | 46.2 | 154.0 | 210 |
| 12 | 160 | 300 | 13 | 52.0 | 180 | 750 | 31.6 | 158.0 | 210 |

NUMBER OF PRINTING PASSES: 4 TIMES

NUMBER OF PRINTING PASSES: 8 TIMES
A
p
m
d = (4 − 1) × m
d = (8 − 1) × m
Ra1
Ra2
Ra3
Ra4
Ra5
Ra6
Ra7
Ra8
94
93
8
6
Rb
Ra
MAIN SCANNING DIRECTION Dm (X)
SUB-SCANNING DIRECTION Ds (+Y)

FIG. 9A

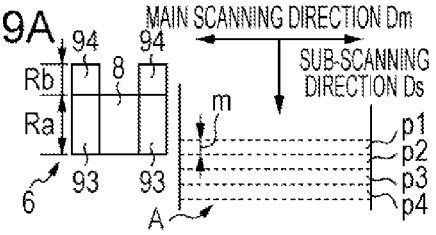

| | INK EJECTION | PRELIMINARY CURING | FULL CURING |
|---|---|---|---|
| p1 | 0 TIMES | 0 TIMES | 0 TIMES |
| p2 | 0 TIMES | 0 TIMES | 0 TIMES |
| p3 | 0 TIMES | 0 TIMES | 0 TIMES |
| p4 | 0 TIMES | 0 TIMES | 0 TIMES |

FIG. 9B

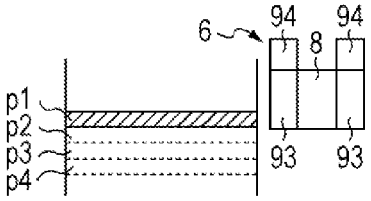

| | INK EJECTION | PRELIMINARY CURING | FULL CURING |
|---|---|---|---|
| p1 | 1 TIME | 1 TIME | 0 TIMES |
| p2 | 0 TIMES | 0 TIMES | 0 TIMES |
| p3 | 0 TIMES | 0 TIMES | 0 TIMES |
| p4 | 0 TIMES | 0 TIMES | 0 TIMES |

FIG. 9C

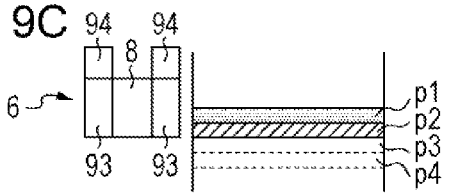

| | INK EJECTION | PRELIMINARY CURING | FULL CURING |
|---|---|---|---|
| p1 | 2 TIMES | 2 TIMES | 0 TIMES |
| p2 | 1 TIME | 1 TIME | 0 TIMES |
| p3 | 0 TIMES | 0 TIMES | 0 TIMES |
| p4 | 0 TIMES | 0 TIMES | 0 TIMES |

FIG. 9D

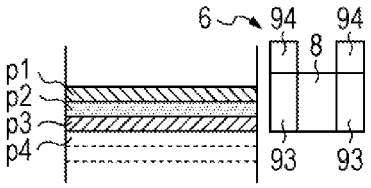

| | INK EJECTION | PRELIMINARY CURING | FULL CURING |
|---|---|---|---|
| p1 | 3 TIMES | 3 TIMES | 0 TIMES |
| p2 | 2 TIMES | 2 TIMES | 0 TIMES |
| p3 | 1 TIME | 1 TIME | 0 TIMES |
| p4 | 0 TIMES | 0 TIMES | 0 TIMES |

FIG. 9E

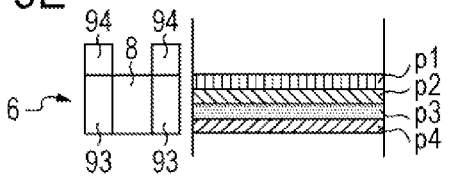

| | INK EJECTION | PRELIMINARY CURING | FULL CURING |
|---|---|---|---|
| p1 | 4 TIMES | 4 TIMES | 0 TIMES |
| p2 | 3 TIMES | 3 TIMES | 0 TIMES |
| p3 | 2 TIMES | 2 TIMES | 0 TIMES |
| p4 | 1 TIME | 1 TIME | 0 TIMES |

FIG. 9F

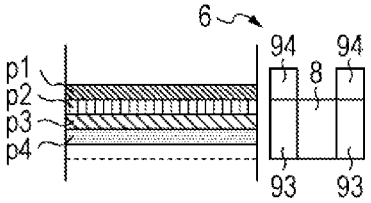

| | INK EJECTION | PRELIMINARY CURING | FULL CURING |
|---|---|---|---|
| p1 | 4 TIMES | 4 TIMES | 1 TIME |
| p2 | 4 TIMES | 4 TIMES | 0 TIMES |
| p3 | 3 TIMES | 3 TIMES | 0 TIMES |
| p4 | 2 TIMES | 2 TIMES | 0 TIMES |

FIG. 9G

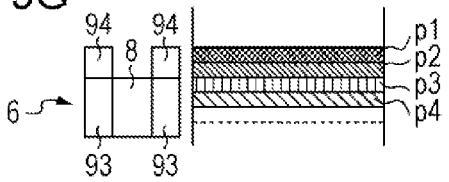

| | INK EJECTION | PRELIMINARY CURING | FULL CURING |
|---|---|---|---|
| p1 | 4 TIMES | 4 TIMES | 2 TIMES |
| p2 | 4 TIMES | 4 TIMES | 1 TIME |
| p3 | 4 TIMES | 4 TIMES | 0 TIMES |
| p4 | 3 TIMES | 3 TIMES | 0 TIMES |

FIG. 10A

GLOSSINESS 60

| NUMBER OF PRINTING PASSES | PRELIMINARY CURING UNIT 93 | | | | FULL CURING UNIT 94 | | | | TOTAL INTEGRATED QUANTITY OF LIGHT |
|---|---|---|---|---|---|---|---|---|---|
| | CURRENT | ILLUMINANCE | DUTY RATIO | FIRST INTEGRATED QUANTITY OF LIGHT | CURRENT | ILLUMINANCE | DUTY RATIO | SECOND INTEGRATED QUANTITY OF LIGHT | |
| | mA | mW/cm$^2$ | % | mJ/cm$^2$ | mA | mW/cm$^2$ | % | mJ/cm$^2$ | mJ/cm$^2$ |
| 4 | 160 | 300 | 51 | 68.0 | 180 | 750 | 85.2 | 142.0 | 210 |
| 6 | 160 | 300 | 30 | 60.0 | 180 | 750 | 60 | 150.0 | 210 |
| 8 | 160 | 300 | 21 | 56.0 | 180 | 750 | 46.2 | 154.0 | 210 |
| 12 | 160 | 300 | 13 | 52.0 | 180 | 750 | 31.6 | 158.0 | 210 |

FIG. 10B

GLOSSINESS 78

| NUMBER OF PRINTING PASSES | PRELIMINARY CURING UNIT 93 | | | | FULL CURING UNIT 94 | | | | TOTAL INTEGRATED QUANTITY OF LIGHT |
|---|---|---|---|---|---|---|---|---|---|
| | CURRENT | ILLUMINANCE | DUTY RATIO | FIRST INTEGRATED QUANTITY OF LIGHT | CURRENT | ILLUMINANCE | DUTY RATIO | SECOND INTEGRATED QUANTITY OF LIGHT | |
| | mA | mW/cm$^2$ | % | mJ/cm$^2$ | mA | mW/cm$^2$ | % | mJ/cm$^2$ | mJ/cm$^2$ |
| 4 | 160 | 300 | 41.3 | 55.1 | 180 | 750 | 93 | 155.0 | 210 |
| 6 | 160 | 300 | 24.5 | 49.0 | 180 | 750 | 64.4 | 161.0 | 210 |
| 8 | 160 | 300 | 16.5 | 44.0 | 180 | 750 | 49.8 | 166.0 | 210 |
| 12 | 160 | 300 | 10.2 | 40.8 | 180 | 750 | 33.9 | 169.5 | 210 |

FIG. 10C

GLOSSINESS 35

| NUMBER OF PRINTING PASSES | PRELIMINARY CURING UNIT 93 | | | | FULL CURING UNIT 94 | | | | TOTAL INTEGRATED QUANTITY OF LIGHT |
|---|---|---|---|---|---|---|---|---|---|
| | CURRENT | ILLUMINANCE | DUTY RATIO | FIRST INTEGRATED QUANTITY OF LIGHT | CURRENT | ILLUMINANCE | DUTY RATIO | SECOND INTEGRATED QUANTITY OF LIGHT | |
| | mA | mW/cm$^2$ | % | mJ/cm$^2$ | mA | mW/cm$^2$ | % | mJ/cm$^2$ | mJ/cm$^2$ |
| 4 | 160 | 300 | – | – | 180 | 750 | – | – | – |
| 6 | 160 | 300 | 35.5 | 71.0 | 180 | 750 | 55.6 | 139.0 | 210 |
| 8 | 160 | 300 | 25.5 | 68.0 | 180 | 750 | 42.6 | 142.0 | 210 |
| 12 | 160 | 300 | 16 | 64.0 | 180 | 750 | 29.2 | 146.0 | 210 |

FIG. 11

| NUMBER OF PRINTING PASSES | FIRST INTEGRATED QUANTITY OF LIGHT [mJ/cm$^2$] | | | | | | | | | | | | | |
|---|---|---|---|---|---|---|---|---|---|---|---|---|---|---|
| | 40 | 41 | 44 | 46 | 49 | 52 | 55 | 56 | 60 | 64 | 68 | 71 | 80 | 100 |
| | GLOSSINESS | | | | | | | | | | | | | |
| 4 | 80 | 80 | 80 | 80 | 80 | 80 | 78 | 76 | 70 | 65 | 60 | 56 | 50 | 40 |
| 6 | 80 | 80 | 80 | 79 | 78 | 76 | 72 | 69 | 60 | 49 | 40 | 35 | 28 | 25 |
| 8 | 80 | 80 | 78 | 77 | 75 | 71 | 64 | 60 | 50 | 41.5 | 35 | 32 | 26 | 25 |
| 12 | 80 | 78 | 76 | 73 | 68 | 60 | 52.5 | 50 | 41 | 35 | 30 | 28 | 25 | 25 |

: OCCURRENCE OF BLEEDING

FIG. 12

| NUMBER OF PRINTING PASSES | TOTAL INTEGRATED QUANTITY OF LIGHT [mJ/cm$^2$] | | | | |
|---|---|---|---|---|---|
| | 150 | 180 | 210 | 240 | 270 |
| | YELLOWING/STATE OF FILM STRENGTH | | | | |
| 4 | A/C | A/B | A/A | A/A | B/A |
| 6 | A/C | A/B | A/A | A/A | B/A |
| 8 | A/B | A/B | A/A | B/A | C/A |
| 12 | A/B | A/B | A/A | B/A | C/A |

YELLOWING
A: NO YELLOWING
B: SLIGHT OCCURRENCE OF YELLOWING
C: OCCURRENCE OF YELLOWING

STATE OF FILM STRENGTH
A: GOOD
B: ACCEPTABLE
C: POOR

FIG. 13

| NUMBER OF PRINTING PASSES | ILLUMINANCE OF PRELIMINARY CURING UNIT 93 [mW/cm$^2$] | | | | |
|---|---|---|---|---|---|
| | 100 | 200 | 250 | 300 | 350 |
| | ADHERENCE STATE | | | | |
| 4 | C | C | B | A | A |
| 6 | C | C | A | A | A |
| 8 | C | C | A | A | A |
| 12 | C | C | A | A | A |

A: GOOD
B: ACCEPTABLE
C: POOR

PRINTING APPARATUS AND PRINTING METHOD

BACKGROUND

1. Technical Field

The invention relates to a printing apparatus and a printing method that allows the number of printing passes, the printing pass ejecting a liquid from a printing head while the printing head is displaced in a main scanning direction, to be set from a plurality of numbers, and, in particular, the present invention relates to a printing apparatus and a printing method to which a printing technique employing a photocurable liquid is applied.

2. Related Art

Hitherto, an apparatus has been known that carries out an operation called a printing pass, the printing pass being an operation in which a print head is displaced in a main scanning direction while a liquid such as ink is ejected onto the printing medium from the print head, for a plurality of times in order to carry out printing on a predetermined width of a printing medium in a sub-scanning direction. Furthermore, as described in JP-A-2004-188891 and JP-A-2009-202418, a printing technique employing a photocurable liquid can be applied to the apparatus. Specifically, in JP-A-2004-188891 and JP-A-2009-202418, light irradiators that move with the print head are provided. Moreover, the light irradiators follow the print head, which moves in the main scanning direction to carry out a printing pass, and irradiate light at the same time; accordingly, light is radiated on the liquid that has been ejected onto the printing medium by the print head and the liquid is cured. In particular, in JP-A-2009-202418, two types of light irradiators (a light irradiator for a preliminary cure and a light irradiator for a full cure) with different irradiation intensities are provided. Moreover, as the printing pass is carried out, a weak light is radiated from the light irradiator for a preliminary cure that follows the print head to promptly perform preliminary curing of the liquid ejected during the printing pass. Furthermore, the light irradiator for a full cure irradiates a strong light on the area of the printing medium where a predetermined number of printing passes have been completed; accordingly, the liquid is fully cured.

The configuration described above, which carries out photoirradiation on the liquid in two stages, namely, the preliminarily curing stage and the fully curing stage, is conceived to have an advantage in stabilizing the image quality. However, as described in JP-A-2004-188891 and JP-A-2009-202418, in apparatuses that carry out printing by executing plural numbers of printing passes, if control of the photoirradiation that is carried out in steps is inadequate, there are cases in which stabilization of the image quality is not efficiently achieved ultimately. In other words, in apparatuses that are provided with a light irradiator that follows the print head as the printing pass is carried out, the integrated quantity of light that will be radiated may increase each time the printing pass is repeated. Accordingly, as pointed out in JP-A-2009-202418, in some cases, the image quality changes depending on the number of printing passes that is carried out for printing and, thus, there are cases in which the image quality is unstable. Accordingly, appropriate control of photoirradiation that is in accordance with the number of printing passes is needed. However, JP-A-2004-188891 and JP-A-2009-202418 do not describe on how to control the photoirradiation, which is carried out in steps, in accordance with the different numbers of printing passes.

SUMMARY

An advantage of some aspects of the invention is that, in the printing technique that carries out ejection of a photocurable liquid from the print head during a printing pass, a technique is provided that is capable of effectively stabilizing the image quality, regardless of the number of printing passes that is carried out, by adequately controlling the photoirradiation that is carried out in steps.

According to an aspect of the invention, a printing apparatus includes a print head that performs a printing pass that ejects a photocurable liquid onto a printing medium while being displaced in a main scanning direction each time the print head is displaced in a sub-scanning direction by a displacing amount of a sub-scanning operation, the sub-scanning direction intersecting the main scanning direction; a first irradiation unit that follows the print head displaced in the main scanning direction while radiating light that cures the liquid; a second irradiation unit that irradiates the light towards an area where irradiation of the light has been completed by the first irradiation unit; a controller that controls a first integrated quantity of light that is an integrated quantity of the light per unit area radiated on the printing medium by the first irradiation unit and that controls a second integrated quantity of light that is an integrated quantity of the light per unit area radiated on the printing medium by the second irradiation unit; and a pass number setting unit that can set the number of printing passes that is performed from a plurality of numbers, wherein the controller reduces the first integrated quantity of light and increases the second integrated quantity of light in accordance with an increase in the number of printing passes that is performed and that is set by the pass number setting unit.

Furthermore, according to an aspect of the invention, a method of printing includes performing a printing pass that displaces a print head towards a main scanning direction while the print head ejects a photocurable liquid onto a printing medium each time the print head is displaced in a sub-scanning direction by a displacing amount of a sub-scanning operation, the sub-scanning direction intersecting the main scanning direction; radiating light, which cures the liquid, towards an area in the printing medium that has a larger width in the sub-scanning direction than the displacing amount of the sub-scanning operation while a first irradiation unit follows the print head, the print head being displaced in the main scanning direction, in the main scanning direction; radiating light with a second irradiation unit towards an area of the printing medium where radiation of light with the first irradiation unit has been completed; setting the number of printing passes that is performed from a plurality of numbers; controlling the print head so that the ejection areas in which the liquid is ejected overlaps one another at least partially in the sub-scanning direction in each of the printing passes continuously carried out for the set number of printing passes; and reducing a first integrated quantity of light that is an integrated quantity of the light per unit area that is radiated on the printing medium by the first irradiation unit and increasing a second integrated quantity of light that is an integrated quantity of the light per unit area that is radiated on the printing medium by the second irradiation unit, in accordance with the set number of printing passes that is performed.

According to the above-described aspects of the invention, in the printing apparatus and the printing method, a printing pass, which displaces the print head in the main scanning direction while the photocurable liquid is ejected towards the printing medium, is carried out each time the print head is displaced in the sub-scanning direction by the displacing amount of the sub-scanning operation. Furthermore, during the printing pass, in order to carry out irradiation of light in a stepwise manner on the liquid that has been ejected onto the printing medium, the first irradiation unit and the second irradiation unit are provided. In other words, the first irradiation unit following the print head carrying out a printing pass is displaced in the main scanning direction while radiating light towards the printing medium. Moreover, the second irradiation unit irradiates light towards the printing medium where irradiation of light by the first irradiation unit has been completed. Accordingly, printing is carried out by sequentially carrying out printing passes and photoirradiations. At this time, according to the aspect of the invention, when the printing pass, which is carried out each time the print head is displaced by the displacing amount of the sub-scanning operation, is carried out sequentially for the set number of printing passes, in each of these printing passes, the ejection region where the print head ejects the liquid overlaps one another at least partially in the sub-scanning direction. In other words, the displacing amount of the sub-scanning operation is set so that ejection of the liquid is repeated on the same area of the printing medium for the set number of printing passes. Accordingly, when the number of printing passes increases, the number of ejection of liquid on the same area of the printing medium increases; thus, the displacement amount in the sub-scanning direction is reduced. Meanwhile, the first irradiation unit, which is displaced in the main scanning direction while following the print head that is carrying out a printing pass, irradiates light towards the area whose width in the sub-scanning direction is greater than the displacing amount of the sub-scanning operation described above. Accordingly, when the printing pass is carried out each time the print head is displaced by the displacing amount of the sub-scanning operation, the first irradiation unit will repeatedly irradiate light to a portion of the area in the sub-scanning direction where light has been radiated during the printing pass immediately before. Moreover, the number of repeated irradiations carried out by the first irradiation unit increases in accordance with the increase in the number of printing pass and in accordance with the decrease in the displacing amount of the sub-scanning operation. As described above, if the number of irradiations on the printing medium changes in accordance with the number of printing passes, the image quality of the printed image may disadvantageously change in accordance with the number of printing passes. Conversely, according to the aspect of the invention, the integrated quantity of light per unit area (first integrated quantity of light) that is radiated on the printing medium by the first irradiation unit and the integrated quantity of light per unit area (second integrated quantity of light) that is radiated on the printing medium by the second irradiation unit are configured to be controlled such that the first integrated quantity of light is reduced and the second integrated quantity of light is increased, in accordance with the increase in the number of printing passes. Accordingly, as will be described in detail later, regardless of the number of printing passes, the image quality can be effectively stabilized.

Note that it is preferable that the controller controls a total integrated quantity of light to be within a predetermined range regardless of the number of printing pass that is performed, the total integrated quantity of light being a sum of the first integrated quantity of light and the second integrated quantity of light. As will be described later, by controlling the total integrated quantity of light within a predetermined range, yellowing occurring in the printed image can be suppressed and the film strength of the printed image can be obtained in a satisfactory manner.

Furthermore, it is preferable that the controller controls the first integrated quantity of light to become a predetermined value or larger regardless of the number of printing pass that is performed. In such an aspect of the invention, the first irradiation unit that carries out photoirradiation towards the printing medium first and the second irradiation unit that carries out photoirradiation towards the printing medium on where photoirradiation by the first irradiation unit has been completed are provided. As described later, by controlling the first integrated quantity of light by the first irradiation unit that carries out the initial photoirradiation to a predetermined value or larger, occurrence of bleeding can be suppressed.

Furthermore, it is preferable that the controller controls an irradiation intensity of the light that is radiated by the first irradiation unit to a predetermined value or larger regardless of the number of printing passes that is performed. As described later, by controlling the irradiation intensity of the first irradiation unit that carries out photoirradiation first to a predetermined value or larger, adhesiveness of the liquid with respect to the printing medium can be improved.

Furthermore, it is preferable that the controller flashes a light source of the first irradiation unit and a light source of the second irradiation unit such that each light source is turned on and off alternately to control an irradiation state of the light from the first irradiation unit and an irradiation state of the light from the second irradiation unit and controls a ratio between a lighting duration of each light source and a no-light duration of each light source to control the first integrated quantity of light and the second integrated quantity of light. According to such a configuration, even if the irradiation intensity is changed, for example, by controlling the ratio between the lighting duration of each light source and the no-light duration of each light source, the first integrated quantity and the second integrated quantity can be controlled appropriately.

Furthermore, it is preferable that an irradiation intensity of the second irradiation unit is higher than an irradiation intensity of the first irradiation unit. Accordingly, the photoirradiation carried out in steps can be carried out in a further satisfactory manner. In other words, the image quality can be stabilized by fully curing (a full cure) the liquid by irradiation of light having a relatively high integrated quantity of light with the second irradiation unit after curing (preliminary curing) the liquid by irradiation of light having a relatively low integrated quantity of light with the first irradiation unit.

Furthermore, it is preferable that the second irradiation unit is provided upstream in the sub-scanning direction with respect to the print head and the first irradiation unit, and a drive mechanism is further included that displaces the print head, the first irradiation unit, and the second irradiation unit downstream in the sub-scanning direction in an integrated manner. According to such a configuration, after a printing pass and photoirradiation with the first irradiation unit are completed on a predetermined area of the printing medium in the sub-scanning direction, by displacing the second irradiation unit downstream in the sub-scanning direction with the drive mechanism, photoirradiation on the predetermined area with the second irradiation unit can be carried out. At this time, according to the above configuration, the print head and the first irradiation unit are also displaced downstream in an integrated manner together with the second irradiation unit; accordingly, printing passes can be carried out on the following downstream areas. Accordingly, printing can be carried out on the printing medium in a continuous and efficient manner.

BRIEF DESCRIPTION OF THE DRAWINGS

The invention will be described with reference to the accompanying drawings, wherein like numbers reference like elements.

FIGS. 9A to 9G are schematic diagrams illustrating examples of the printing operation of the printer of FIG. 1.

FIGS. 10A to 10C are diagrams each illustrating an irradiation condition for setting glossiness to a predetermined value.

FIG. 11 is a diagram illustrating glossiness when a first integrated quantity of light was changed.

FIG. 12 is a diagram illustrating the yellowing statuses and the states of the film strength when the total integrated quantity of light was changed.

FIG. 13 is a diagram illustrating the states of adhesion when the illuminance of a preliminary curing unit was changed.

DESCRIPTION OF EXEMPLARY EMBODIMENTS

Figure 1:
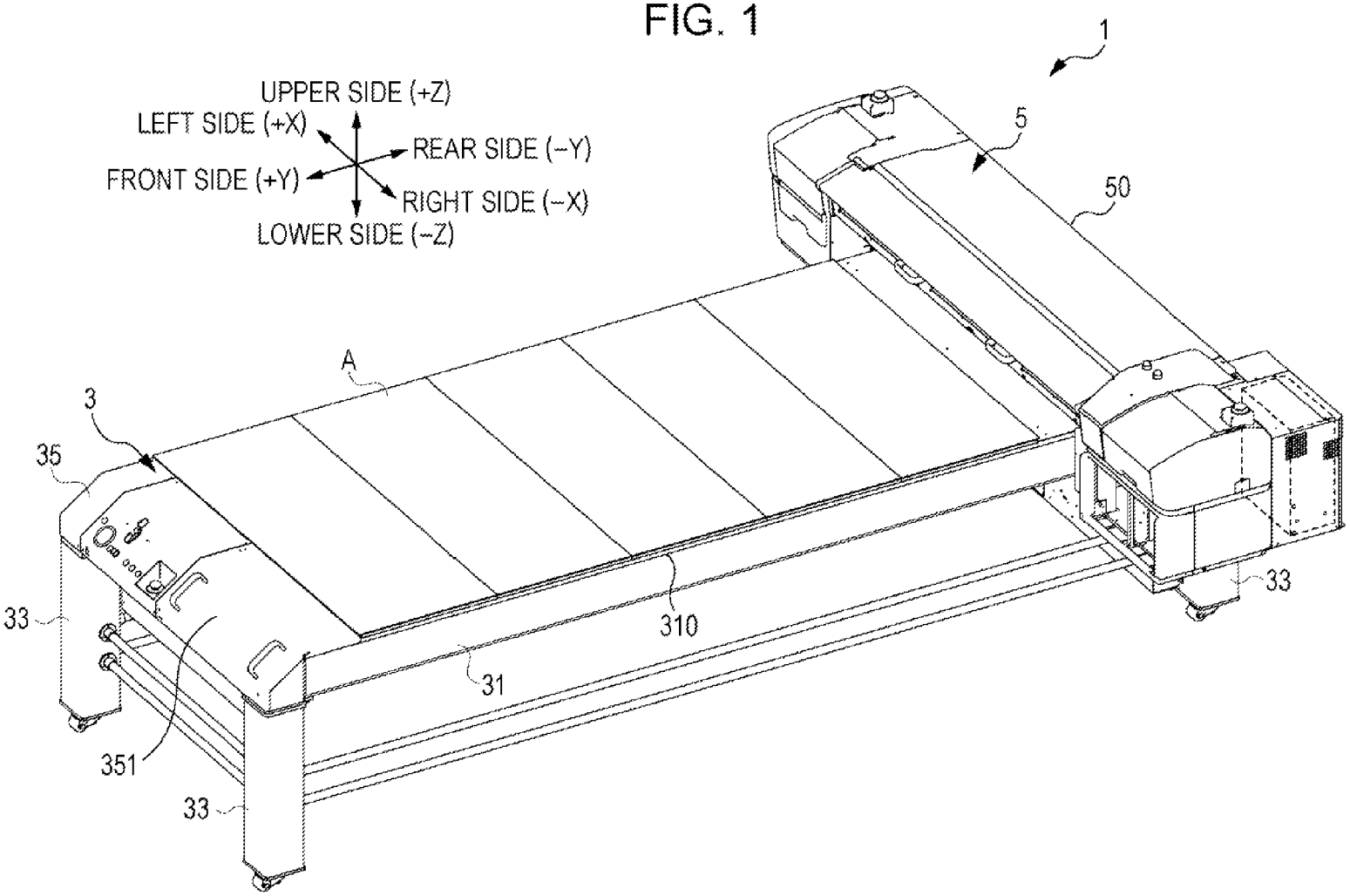
FIG. 1 is a perspective view partially illustrating an example of a configuration of a printer to which the invention can be applied.

FIG. 1 is a perspective view partially illustrating an example of a configuration of a printer to which the invention can be applied. In FIG. 1 and the following drawings, an xyz orthogonal coordinate system including a left-right direction X, a front-rear direction Y, and a direction of gravity Z is illustrated as appropriate. A printer 1 prints an image on a printing medium A by ejecting ultraviolet (UV) ink, which is a type of ultraviolet ray curing ink that is cured by irradiation of ultraviolet rays, using an ink jet method. The printing medium A includes various mediums such as posters, panels, and signboards. The printer 1 is a so-called flatbed type printer in which printing is carried out by ejecting UV ink onto a printing medium A from a print head while the print head mounted on a print processing unit 5 is displaced with respect to the printing medium A that is horizontally supported by a support stage 3.

Figure 2:
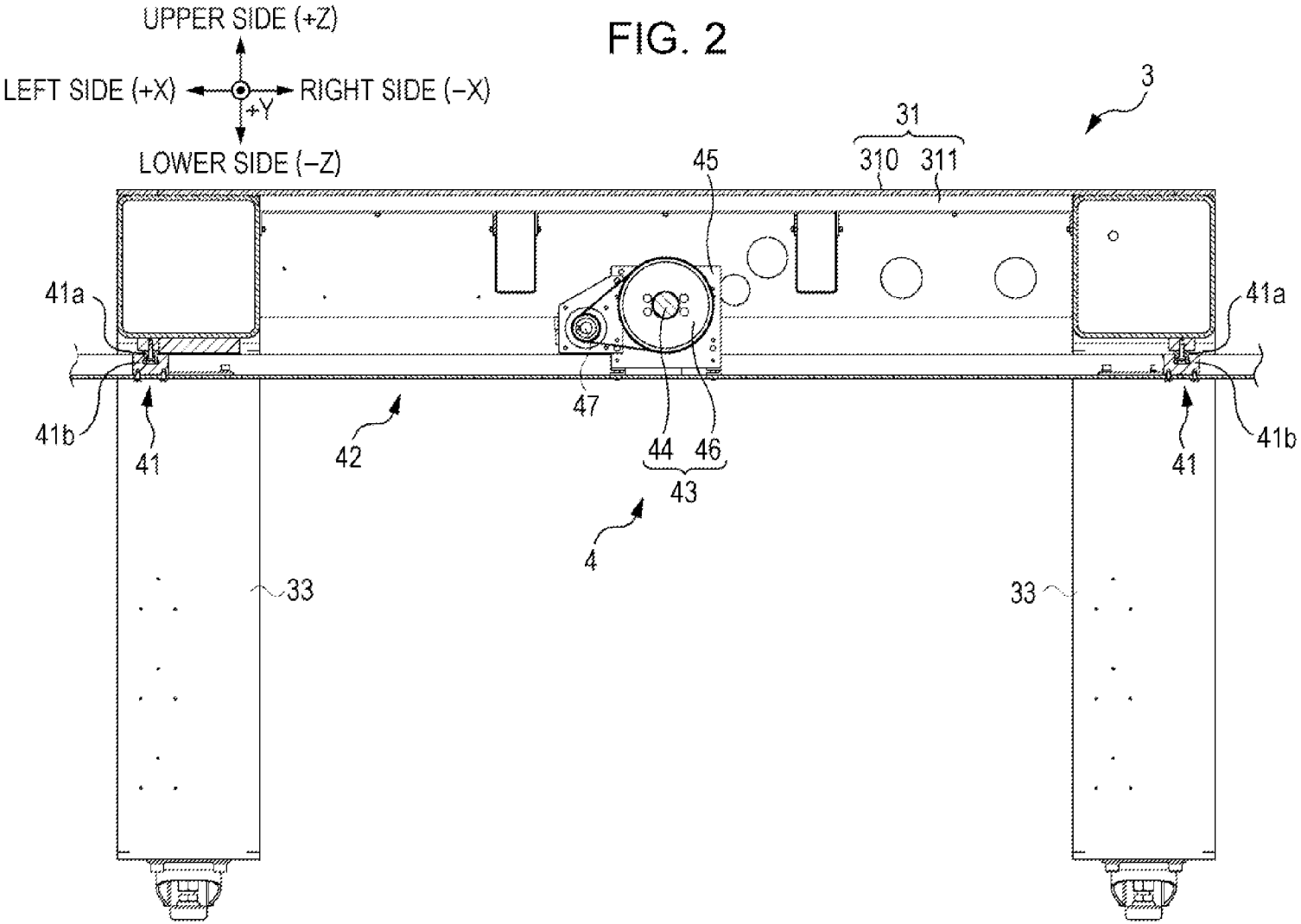
FIG. 2 is a front view partially illustrating a configuration of a support stage included in the printer illustrated in FIG. 1.

FIG. 2 is a front view partially illustrating a configuration of a support stage included in the printer illustrated in FIG. 1. Note that in FIG. 2, other than the support stage 3, a sub-scanning displacing unit 4 described later is also depicted. The support stage 3 includes a substantially flat-plate-shaped suction stage 31 that is long in the front-rear direction Y and that is supported by leg member 33 at its four corners and is capable of moving by means of casters that are attached to the lower end of the leg member 33. The suction stage 31 includes a mounting flat surface 310 that faces upwards and that is supported in a horizontal manner. The printing medium A is mounted on the mounting flat surface 310. A plurality of suction openings (not shown) are open upwards in the mounting flat surface 310 of the suction stage 31. By carrying out suction through the plurality of suction openings with a built-in suction chamber 311, the suction stage 31 draws and adheres the printing medium A to the mounting flat surface 310.

The support stage 3 includes an operation panel 35 that is provided in front of the suction stage 31. By operating the operation panel 35, the operator can give commands to the printer 1. Furthermore, an open/close opening 351 is provided on substantially the right side of the operation panel 35. The open/close opening 351 is provided in a manner allowing the operator to manually carry out maintenance of the print processing unit 5. Specifically, the print processing unit 5 is moved towards the front side (+Y side) in the front-rear direction Y from the state illustrated in FIG. 1 such that the open/close opening 351 and the print processing unit 5 become adjacent to each other; accordingly, the operator can access the print processing unit 5 through the open/close opening 351 that is in an open state and carry out maintenance manually.

As illustrated together with the support stage 3 in FIG. 2, the printer 1 includes the sub-scanning displacing unit 4 that moves the print processing unit 5 in the front-rear direction Y. The sub-scanning displacing unit 4 includes a pair of left and right guide mechanisms 41 that is provided on the backside of the support stage 3, and a connection frame 42 that connects the print processing unit 5 and the guide mechanisms 41 to each other. Each guide mechanism 41 is constituted by an LM guide (registered trademark) and includes a guide rail 41*a* that extends in the front-rear direction Y and that is fixed to the support stage 3, and a slider 41*b* that slides in the front-rear direction Y with respect to the guide rail 41*a*. Moreover, the print processing unit 5 is attached to the slider 41*b* through the connection frame 42. Accordingly, the sub-scanning displacing unit 4 supports and moves the print processing unit 5 in the front-rear direction Y with the guide mechanism 41.

Furthermore, the sub-scanning displacing unit 4 includes a sub-scanning drive mechanism 43 that drives the print processing unit 5 along the guide mechanism 41 in the front-rear direction Y. The sub-scanning drive mechanism 43 includes a screw shaft 44 that extends in the front-rear direction Y and that is fixed to the support stage 3, and a nut 46 that is attached to the connection frame 42 through a support member 45 in a rotatable manner and that is screwed onto the screw shaft 44. The sub-scanning drive mechanism 43 moves the print processing unit 5 in the front-rear direction Y (a sub-scanning direction) by driving (rotating) the nut 46 with a sub-scanning motor 47.

Figure 3:
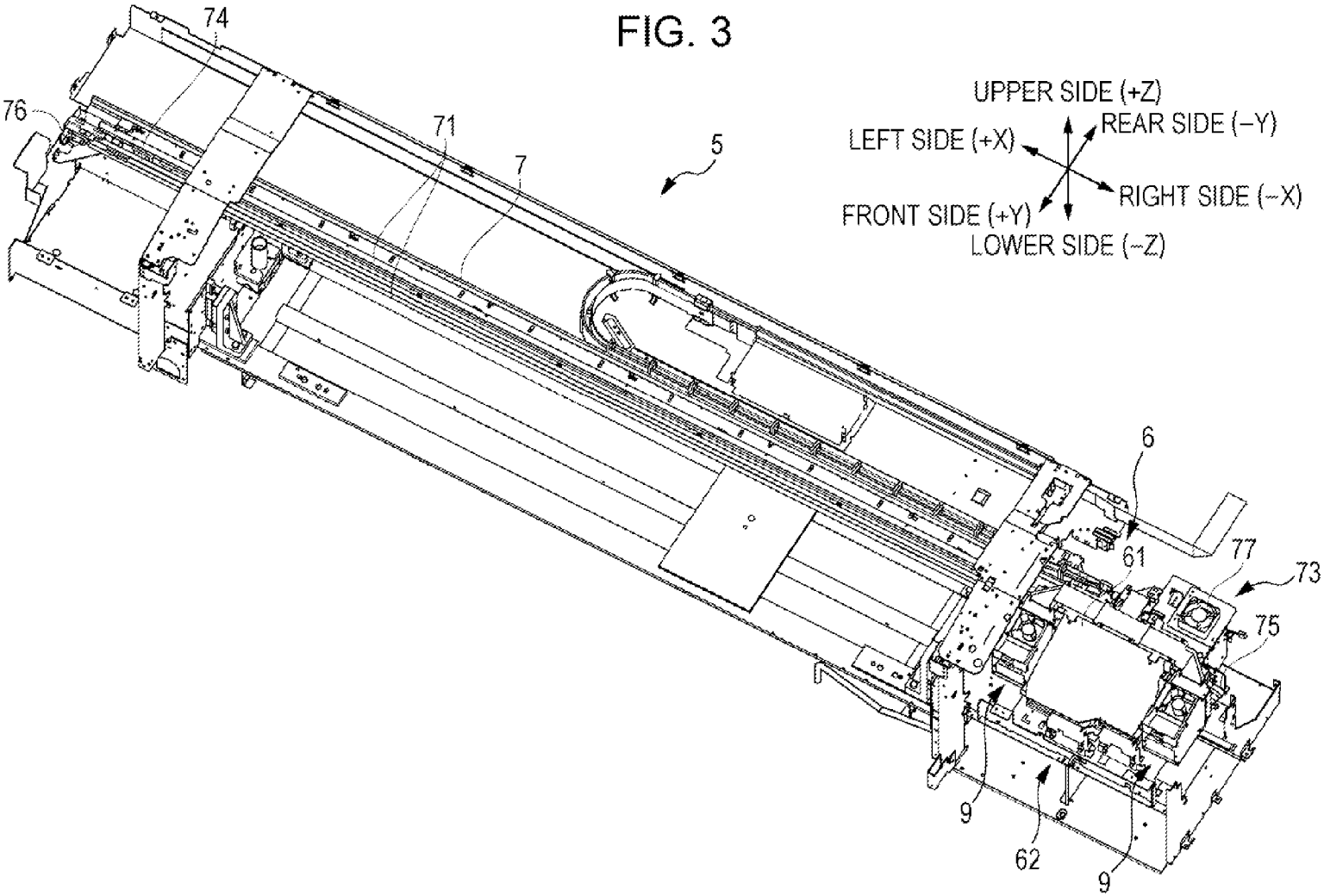
FIG. 3 is a perspective view partially illustrating a configuration of an interior of a print processing unit included in the printer illustrated in FIG. 1.
Figure 4:
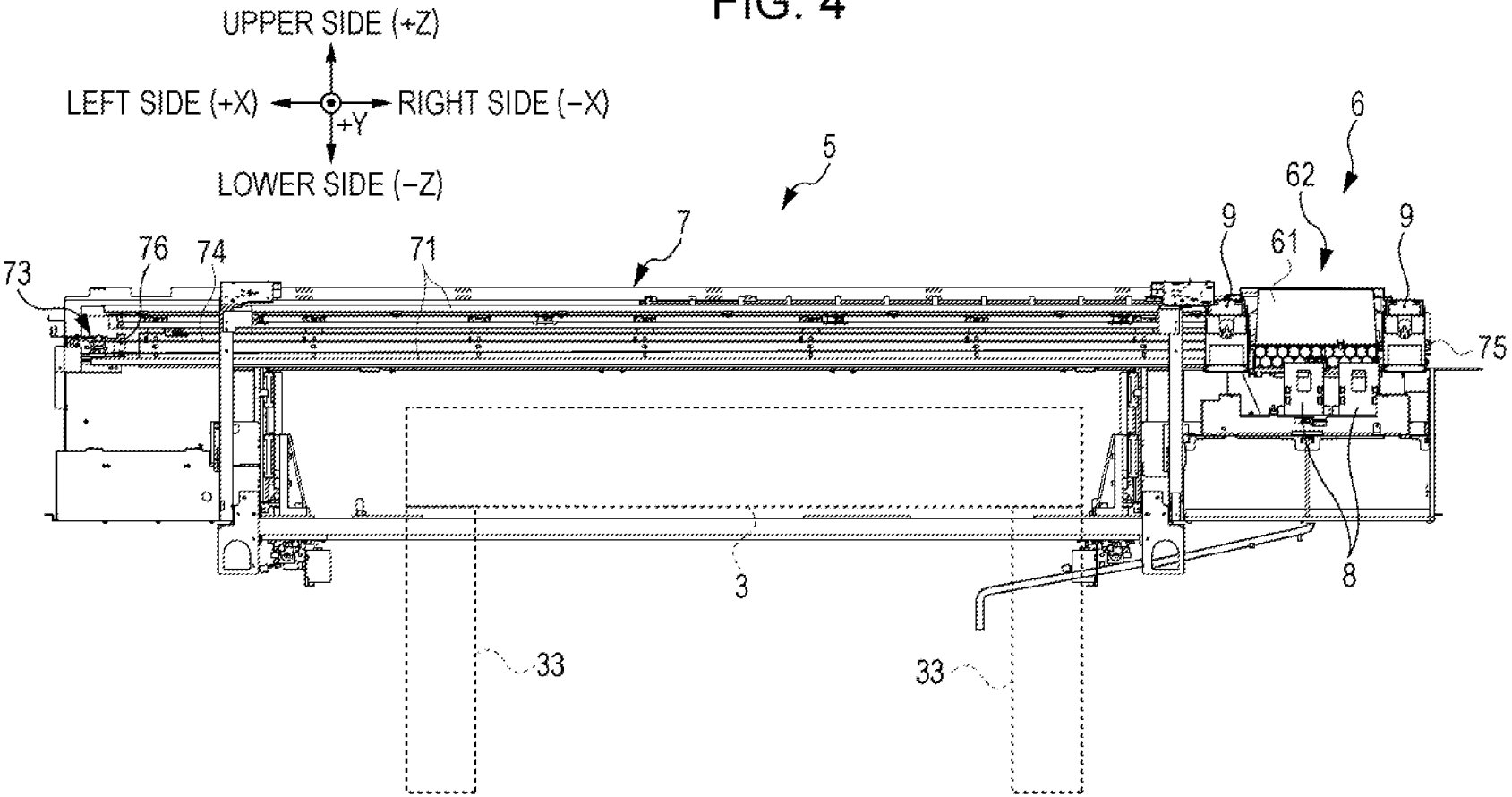
FIG. 4 is a front view partially illustrating the configuration of the interior of a print processing unit included in the printer illustrated in FIG. 1.

The print processing unit 5 is of a so-called gantry type and includes a housing 50 (FIG. 1). The housing 50 crosses over the support stage 3 in the left-right direction X and accommodates therein the print head and various functional units. FIG. 3 is a perspective view partially illustrating a configuration of an interior of a print processing unit included in the printer illustrated in FIG. 1 and FIG. 4 is a front view partially illustrating the configuration of the interior of a print processing unit included in the printer illustrated in FIG. 1.

The print processing unit 5 accommodates in the housing 50 a printing unit 6 on which the print head is mounted and a main scanning displacing unit 7 that moves the printing unit 6 in the left-right direction X. The main scanning displacing unit 7 includes a pair of upper and lower guide shafts 71 that supports the printing unit 6 so that the printing unit 6 can reciprocate in the left-right direction X and a main scanning drive mechanism 73 that drives the printing unit 6 along the guide shafts 71 in a linear manner in the left-right direction X. In the main scanning drive mechanism 73, a timing belt 74 that extends along the guide shafts 71 in the left-right direction X is stretched between a drive pulley 75 and a driven pulley 76. The printing unit 6 that is connected to the timing belt 74 is moved in the left-right direction X by driving the drive pulley 75 with a main scanning motor 77. Accordingly, forward and reverse rotations of the main scanning motor 77 reciprocate the printing unit 6 in the left-right direction X (a main scanning direction) through the timing belt 74.

Figure 5:
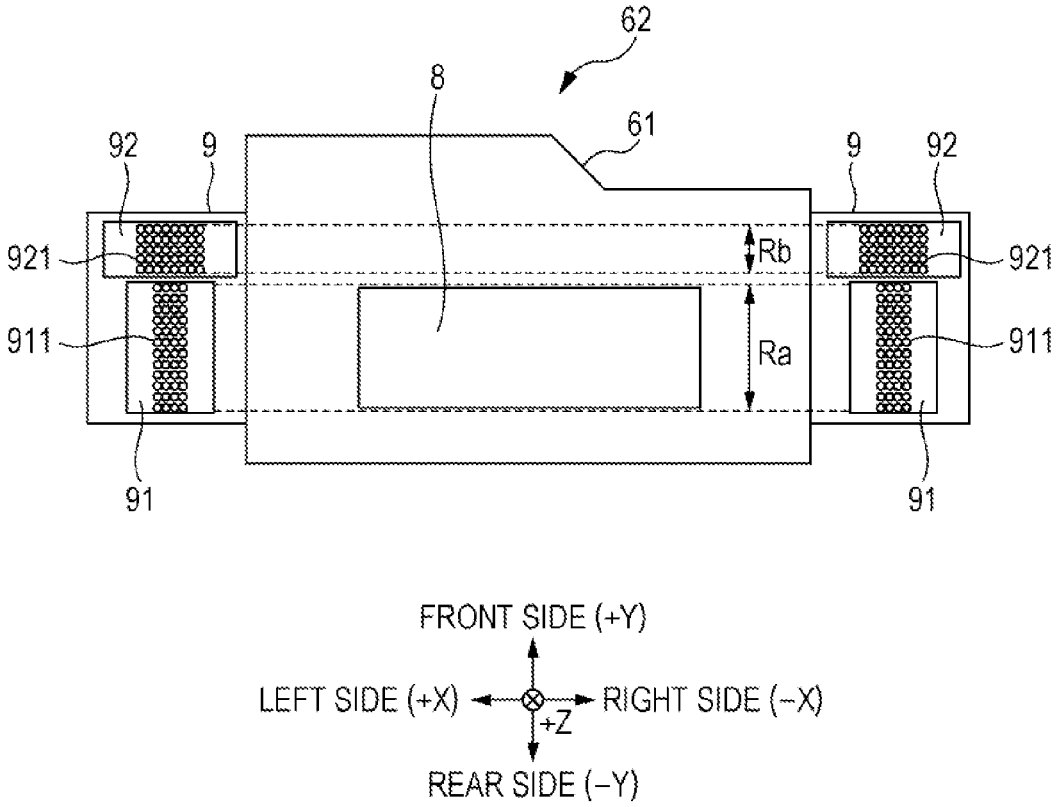
FIG. 5 is a bottom view schematically illustrating a configuration of the components included in the printing unit.

FIG. 5 is a bottom view schematically illustrating a configuration of the components included in the printing unit. The printing unit 6 includes a carriage unit 62 having a box-shaped carriage 61, in which a print head 8 is mounted, and ultraviolet ray irradiators 9 that are fixed on the left and right sides of the carriage unit 62. The print head 8 includes nozzles that are open towards the mounting flat surface 310 and that eject UV ink.

More specifically, the print head 8 includes a plurality of nozzle rows that are arranged in the left-right direction X in which each of the nozzle rows is a plurality of nozzles (not shown) that are arranged in a straight line in the front-rear direction Y. The nozzle rows eject UV ink of different colors. Note that the ejection of UV ink from the nozzles is carried out using an ink jet method in which the nozzles are driven with piezoelectric elements. The print head 8 faces a region Ra that has a predetermined width in the front-rear direction Y. The print head 8 prints image in the region Ra by ejecting ink onto the region Ra while moving parallel to the main scanning direction X.

Each ultraviolet ray irradiator 9 includes a light source substrate 91 for a preliminary cure and a light source substrate 92 for a full cure that are arranged in the front-rear direction Y. Specifically, the light source substrate 91 is arranged on the rear side (−Y side) in the front-rear direction Y and the light source substrate 92 is arranged on the front side (+Y side) in the front-rear direction Y. The light source substrate 91 for a preliminary cure includes a plurality of light sources 911 that face the mounting flat surface 310 and that are arranged in a matrix in the left-right direction X and the front-rear direction Y. Each light source 911 irradiates ultraviolet rays on a printing medium A on the mounting flat surface 310. Note that the region in which the light sources 911 are arranged in the light source substrate 91 overlaps the region Ra in the front-rear direction Y when viewed from the bottom surface; accordingly, the light source substrate 91 irradiates ultraviolet rays in the region Ra.

Meanwhile, the light source substrate 92 for a full cure includes a plurality of light sources 921 that face the mounting flat surface 310 and that are arranged in a matrix in the left-right direction X and the front-rear direction Y. Each light source 921 irradiates ultraviolet rays on a printing medium A on the mounting flat surface 310. Note that the region in which the light sources 921 are arranged in the light source substrate 92 overlaps a region Rb in the front-rear direction Y when viewed from the bottom surface; accordingly, the light source substrate 92 irradiates ultraviolet rays in the region Rb. Note that the region Rb is an area that is positioned on the front side (+Y side) in the front-rear direction Y with respect to the region Ra and has a length in the front-rear direction Y that is smaller than that of the region Ra (half the length of the region Ra in the exemplary embodiment).

The light sources 911 and 921 of the light source substrates 91 and 92, respectively, are light emitting diodes (LEDs), for example. In the present exemplary embodiment, the same components are used for the light sources 911 of the light source substrate 91 and the light sources 921 of the light source substrate 92; however, different components may be used. As can be understood from FIG. 5, the area in which the light sources 921 for a full cure are arranged is wider in the left-right direction X with respect to the area in which the light sources 911 for a preliminary cure are arranged. Moreover, the integrated quantity of light of ultraviolet rays radiated from the light sources 911 for a preliminary cure is set smaller than the integrated quantity of light of ultraviolet rays radiated from the light sources 921 for a full cure. In other words, the integrated quantity of light of ultraviolet rays radiated by the light source substrate 91 for a preliminary cure on the UV ink, which has been ejected onto the printing medium A by the print head 8, is relatively small; accordingly, the UV ink is cured (preliminarily cured) to the extent allowing its shape to be maintained and is not fully cured. On the other hand, the integrated quantity of light of ultraviolet rays radiated by the light source substrate 92 for a full cure on the UV ink, on which ultraviolet rays have already been radiated by the light source substrate 91, in other words, the UV ink that was preliminarily cured, is relatively large; accordingly, the UV ink is fully cured. Note that full curing not only refers to a state in which UV ink is totally cured but also refers to a state in which UV ink ejected onto the printing medium A is cured to the extent that stops the ink from spreading on the printing medium A. Furthermore, UV ink in a preliminarily cured state may be made to reach a fully cured state with a single main scan or may be made to reach a fully cured state with a plurality of main scans.

The printer 1 configured as above carries out printing on a printing medium A by appropriately performing a main scanning operation and a sub-scanning operation. Specifically, the main scanning operation is carried out by displacing the printing unit 6 by means of the main scanning drive mechanism 73 in either of the forward and backward directions of the main scanning direction X (a direction in which the print head 8 relatively moves with respect to the recording medium A while UV ink is ejected so as to carry out printing) while UV ink is ejected from the print head 8. An image is printed with a single main scanning operation while UV ink is ejected in the region Ra. Note that the main scanning operation can be carried out in either of the forward and backward directions of the main scanning direction X. When a plurality of main scanning operations are repeatedly carried out, a main scanning operation in the forward direction and a main scanning operation in the backward direction is alternately carried out.

The sub-scanning operation is an operation carried out by displacing the print processing unit 5 by the displacement amount of the sub scanning operation in a sub-scanning direction Y (a direction heading towards the rear side −Y from the front side +Y), which is orthogonal to the main scanning direction X, by means of the sub-scanning drive mechanism 43. A single sub-scanning operation displaces the region Ra, in which the print head 8 ejects UV ink, in the sub-scanning direction Y with respect to the printing medium A by the displacement amount of the sub-scanning operation. By carrying out the sub-scanning operation each time the main scanning operation is completed, printing can be carried out in the region Ra while displacing the region Ra in the sub-scanning direction Y; accordingly, an image can be printed on the entire surface of the printing medium A.

Furthermore, the light sources 911 and 921 of the ultraviolet ray irradiator 9 radiate ultraviolet rays during the main scanning operation and cure the UV ink that was ejected onto the printing medium A by the print head 8. First, the operation of the light sources 911 for a preliminary cure will be described. While the main scanning operation is carried out, the light sources 911 of the ultraviolet ray irradiator 9 that are on the rear side of the print head 8 with respect to the moving direction during the main scanning operation are turned on. Accordingly, the ultraviolet ray irradiator 9 on the rear side moves so as to follow the print head 8 and ultraviolet rays are radiated on the UV ink that was ejected onto the region Ra during the main scanning operation; thus, the UV ink is preliminarily cured. Note that not limited to the above, the light sources 911 of the ultraviolet ray irradiator 9 positioned on the front side of the print head 8 with respect to the moving direction during the main scanning operation can be radiated as well. Accordingly, ultraviolet rays can be radiated onto the UV ink that was ejected onto the printing medium A in the preceding main scanning operation.

Meanwhile, the operation of the light sources 921 for a full cure is as follows. During execution of the main scanning operation, the light sources 921 of the ultraviolet ray irradiator 9 that are on the rear side of the print head 8 with respect to the moving direction during the main scanning operation are turned on. Note that the region Rb in which the light source 921 irradiates ultraviolet rays is offset to the front side (+Y side) in the sub-scanning direction Y with respect to the region Ra in which the print head 8 carrying out the main scanning operation ejects UV ink. Accordingly, when printing is carried out while the sub-scanning operation is carried out from the front side (+Y) to the rear side (−Y), the light source 921 fully cures the UV ink that was ejected onto the printing medium A during the previous main scanning operation and that was preliminarily cured. Moreover, each time a sub-scanning operation is carried out, the region Rb to which full curing is carried out by the light source 921 is displaced to the rear side (−Y) in the sub-scanning direction Y; accordingly, full curing can be carried out over the entire surface of the printing medium A.

Figure 6:
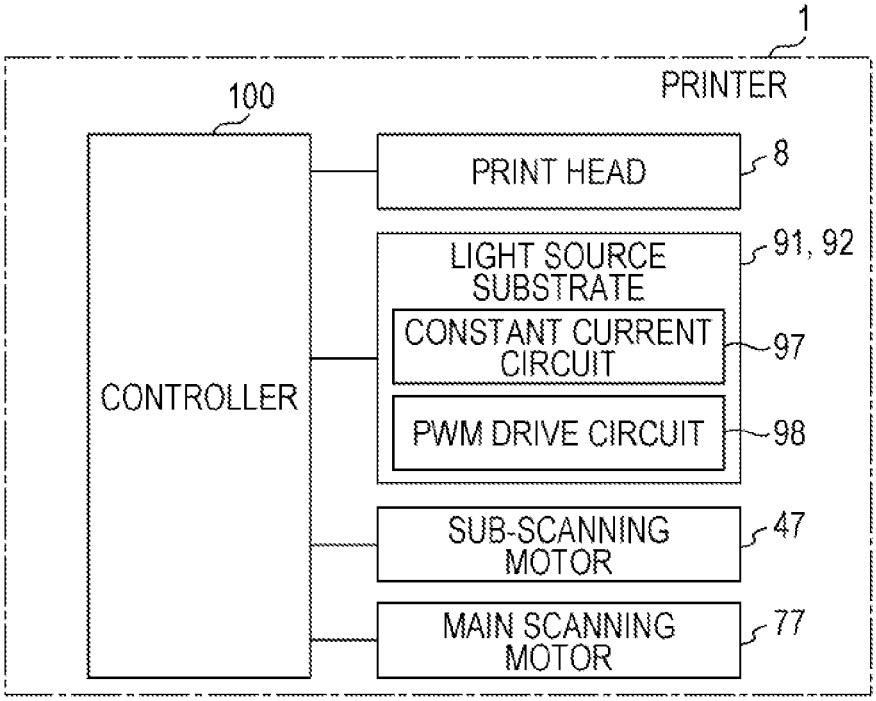
FIG. 6 is a block diagram illustrating an example of an electrical configuration of the printer illustrated in FIG. 1.
Figure 7:
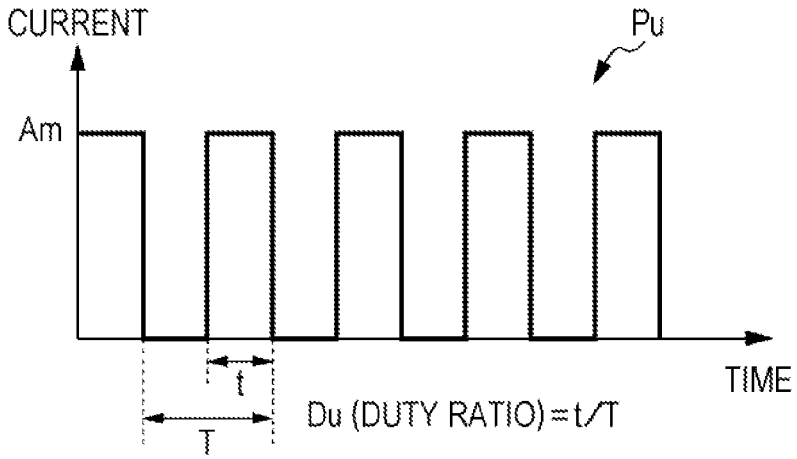
FIG. 7 is a diagram illustrating an example of a pulse current that is applied to a light source.

FIG. 6 is a block diagram illustrating an example of an electrical configuration of the printer illustrated in FIG. 1 and FIG. 7 is a diagram illustrating an example of a pulse current that is applied to a light source. The printer 1 configured as above controls the printing operation with a controller 100. In other words, when printing is carried out by the printer 1, the controller 100 sends an operating command to the sub-scanning motor 47 such that a sub-scanning operation is carried out in which the print processing unit 5 is displaced in the sub-scanning direction Y by the amount of displacement of the sub scanning operation. Moreover, each time a sub-scanning operation is completed, the controller 100 sends an operating command to the main scanning motor 77 and a main scanning operation in which the printing unit 6 is displaced in the main scanning direction X is carried out. During the main scanning operation, the controller 100 sends operating commands to the print head 8 and the light source substrates 91 and 92; accordingly, UV ink is ejected from the print head 8 and ultraviolet rays are radiated from the light sources 911 and 921 of the ultraviolet ray irradiator 9.

The controller 100 flashes the light sources 911 and 921 with the functions of the light source substrates 91 and 92, respectively. The controller 100 turns the light sources 911 and 921 on and off alternately to control the irradiation state of the ultraviolet rays from the light sources 911 and 921. More specifically, the light source substrates 91 and 92 are provided with a constant current circuit 97 and a pulse width modulation (PWM) drive circuit 98. Moreover, in accordance with the operating command from the controller 100, an amplitude Am of a square wave pulse current Pu (see FIG. 7) that is applied to the light sources 911 and 921 is controlled by the constant current circuit 97 and a duty ratio Du (Du=t/T, a ratio between period T and lighting duration t) of the pulse current Pu is controlled by the PWM drive circuit 98. Moreover, the light sources 911 and 921 irradiate ultraviolet rays with illuminances (irradiation intensities) that are in accordance with the amplitude Am. Furthermore, when the speed of the main scanning operation of the print head 8 is constant, the integrated quantity of ultraviolet rays radiated by the light sources 911 and 921 is set in accordance with the amplitude Am and the duty ratio Du. According to such a configuration, as will be described later, even if the illuminances of the light sources 911 and 921 are changed, for example, the integrated quantity of ultraviolet rays radiated by the light sources 911 and 921 can be controlled appropriately by controlling the ratio between the lighting duration of the light sources 911 and 921 and the no-light duration of the light sources 911 and 921.

Figures 8A, 8B:
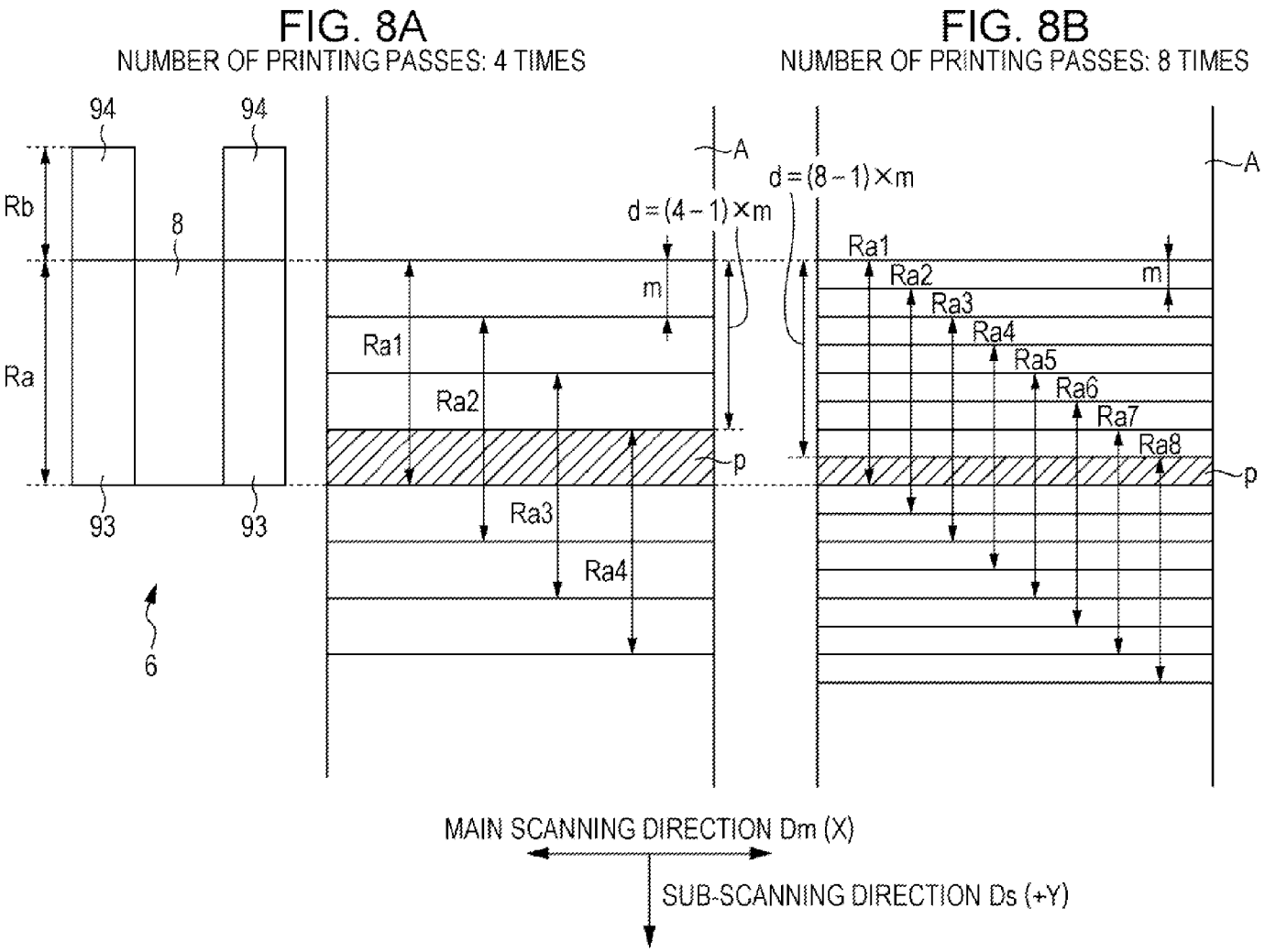
FIGS. 8A and 8B are schematic diagrams each illustrating an outline of a printing operation of the printer of FIG. 1.

FIGS. 8A and 8B are schematic diagrams each illustrating an outline of a printing operation of the printer of FIG. 1. More specifically, FIG. 8A illustrates a case in which the number of printing passes described later, which is the number of times the printing pass has been carried out, is four, and FIG. 8B illustrates a case in which the number of printing passes is eight. Note that, hereinafter, an irradiation unit including the light source substrate 91 and the light sources 911 is referred to as a preliminary curing unit 93, and an irradiation unit including the light source substrate 92 and the light sources 921 is referred to as a full curing unit 94.

In the printer 1, a printing pass is carried out in which UV ink is ejected from the print head 8 onto an ejection region Ra while the printing unit 6 is displaced in a main scanning direction Dm (X direction). Furthermore, a printing pass is carried out each time the printing unit 6 (print processing unit 5) is displaced in a sub-scanning direction Ds (a direction heading towards +Y from −Y) by a displacing amount m of the sub-scanning operation. At this time, at least a portion of the ejection ranges Ra, which are areas where the print head 8 ejects UV ink while printing passes are successively carried out for a preset number of times, overlaps each other in the sub-scanning direction Ds.

For example, as illustrated in FIG. 8A, when the number of printing passes is four, ejection ranges Ra1 to Ra4 of the four printing passes overlaps each other at an area p in the sub-scanning direction Ds. In other words, UV ink is repeatedly ejected for four times onto the area p where the ejection ranges Ra1 to Ra4 overlap each other. For example, if the ejection region Ra of the print head 8 is unchanged and the displacing amount m of the sub-scanning operation is constant at all times, then, by setting the displacing amount m of the sub-scanning operation to one fourth of the ejection region Ra, the number of times in which UV ink is repeatedly ejected onto the area p, in other words, the number of printing passes, can be four.

Incidentally, there are cases in which the repeated number of ejections of the UV ink onto the printing medium A is changed due to change in print resolution or change in print quality, for example. As described above, change in the number of printing passes described above changes the repeated number of ink ejection. For example, as illustrated in FIG. 8B, when the number of printing passes is eight, ejection ranges Ra1 to Ra8 of the eight printing passes overlaps each other at an area p. In other words, UV ink is repeatedly ejected for eight times onto the area p where the ejection ranges Rat to Ra8 overlap each other. Similar to the above case, for example, if the ejection region Ra of the print head 8 is unchanged and the displacing amount m of the sub-scanning operation is constant at all times, then, by setting the displacing amount m of the sub-scanning operation to one eighth of the ejection region Ra, the number of times in which UV ink is repeatedly ejected onto the area p, in other words, the number of printing passes, can be eight.

As described above, an increase in the number of printing passes decreases the displacing amount m of the sub-scanning operation in an inversely proportional manner. Moreover, as described next, when the displacing amount m of the sub-scanning operation is decreased in accordance with the increase in the number of printing passes, the repeated number of irradiation of ultraviolet rays on the printing medium A carried out by the preliminary curing unit 93 increases as well. In other words, the preliminary curing unit 93 follows the print head 8 while the printing pass is executed and irradiates light to the irradiation region Ra. Moreover, as described above, the printing pass is repeatedly executed while the print head 8 is displaced in the sub-scanning direction Ds by the displacing amount m of the sub-scanning operation. Accordingly, the irradiation ranges Ra, which are areas where the preliminary curing unit 93 irradiates ultraviolet rays during the repeated printing passes, are offset against one another in the sub-scanning direction Ds by the displacing amount m of the sub-scanning operation. In this case, the displacing amount m of the sub-scanning operation is smaller than the irradiation region Ra in the sub-scanning direction Ds (Ra>m). Accordingly, the irradiation ranges Ra of the preliminary curing unit 93 during the repeated printing passes overlap one another in the sub-scanning direction Ds by an overlapping width of generally (Ra−m>0). In other words, photoirradiation is carried out at least twice with the preliminary curing unit 93 on the area where there is an overlap. Moreover, the number of photoirradiation repeatedly carried out on the same area increases in an inversely proportional manner with respect to the displacing amount m of the sub-scanning operation.

The above point will be described by citing specific examples. Note that while FIG. 8 described above is a schematic diagram for describing the overlapping area of the ejection ranges Ra, since the irradiation region Ra of the preliminary curing unit 93 and the ejection region Ra of the print head 8 are the same in the present exemplary embodiment, the overlapping area of the irradiation ranges Ra and that of the ejection region Ra during each printing pass are the same as the overlapping area in FIG. 8. For example, if the displacing amount m of the sub-scanning operation is constant and the printing pass is repeated for an "n" number of times, the irradiation region Ra of the first printing pass and the irradiation region Ra of the nth printing pass are offset against each other in the sub-scanning direction Ds by an offset amount d=(n−1)×m. If the offset amount d is greater than the irradiation region Ra in the sub-scanning direction Ds (d>Ra), then there will be no overlapping between the irradiation region Ra of the first printing pass and the irradiation region Ra of the nth printing pass. On the other hand, if the offset amount d is smaller than the irradiation region Ra (d<Ra), then there will be an overlapping between the irradiation region Ra of the first printing pass and the irradiation region Ra of the nth printing pass. In such a case, since there are overlaps in the irradiation ranges Ra of the printing passes between the first to nth printing passes, photoirradiation is repeatedly carried out n times to the same area p. In other words, as long as the condition d<Ra, that is, (n−1)×m<Ra is satisfied, photoirradiation will be repeatedly carried out n times to the same area p. Note that, as can be understood from the above conditional expression, when the irradiation region Ra is constant and the displacing amount m of the sub-scanning operation is small, the repeated number n of photoirradiations increases. Accordingly, when the displacing amount m of the sub-scanning operation decreases in accordance with the increase in the number of printing passes, the repeated number of irradiation of ultraviolet rays carried out by the preliminary curing unit 93 on the printing medium A increases as well.

In particular, since the irradiation region Ra of the preliminary curing unit 93 and the ejection region Ra of the print head 8 are the same in the present exemplary embodiment, the number of irradiations carried out by the preliminary curing unit 93 coincides with the number of printing passes. In other words, when the number of printing passes is four, the number of repeated irradiations carried out by the preliminary curing unit 93 is four, and when the number of printing passes is eight, the number of repeated irradiations carried out by the preliminary curing unit 93 is eight, for example. Note that, in the present exemplary embodiment, since the full curing unit 94 is also provided in the printing unit 6 together with the print head 8 in an integrated manner, the full curing unit 94 is displaced together with the print head 8 in the main scanning direction Dm when a printing pass is carried out. Furthermore, the length of the irradiation region Rb of the full curing unit 94 is greater than the displacing amount m of the sub-scanning operation in the sub-scanning direction Ds. Accordingly, similar to the preliminary curing unit 93, in accordance with the increase in the number of printing passes, the repeated number of irradiations of the ultraviolet rays on the printing medium A by means of the full curing unit 94 is increased as well.

A printing operation carried out by the printer 1 will be described next in detail with reference to FIGS. 9A to 9G. FIGS. 9A to 9G are schematic diagrams illustrating examples of the printing operation of the printer of FIG. 1. Note that, in the printer 1, the number of printing passes described above can be set from among a plurality of numbers (four times, six times, eight times, and twelve times, for example) according to a user command sent through an operation unit (not shown). Moreover, FIGS. 9A to 9G illustrate a printing operation in which the number of printing passes is set to four.

FIGS. 9A to 9G illustrate a printing operation in a serial manner until printing is completed on a predetermined area p1 of the printing medium A in the sub-scanning direction Ds, in which ejection of ink by the print head 8 and photoirradiation by the preliminary curing unit 93 are each carried out four times and, furthermore, photoirradiation with the full curing unit 94 is carried out twice. Note that since the number of printing passes is set to four, as described above, the displacing amount m of the sub-scanning operation is set to one fourth of the ejection region Ra and the length of the area p1 in the sub-scanning direction Ds is also set to one fourth of the ejection region Ra. Furthermore, areas that are positioned downstream of the area p1 in the sub-scanning direction Ds and that each have an area that is the same as the area p1 are referred to as, from the upstream side to the downstream side and in this order, areas p2, p3, and p4.

First, in accordance with an operating command from the controller 100, the printing unit 6 (print processing unit 5) is displaced in the sub-scanning direction Ds by the displacing amount m of the sub-scanning operation such that the downstream portions of the print head 8 and the preliminary curing unit 93 in the sub-scanning direction Ds, that is, one fourth of the ejection region Ra, overlap with the area p1 of the printing medium A (FIG. 9A). Next, in accordance with an operating command from the controller 100, the printing unit 6 is displaced in the main scanning direction Dm from the left side to the right side of the figure such that a first printing pass is carried out on the area p1 (FIG. 9B). In other words, the print head 8 that faces the area p1 is displaced in the main scanning direction Dm while UV ink is ejected towards the printing medium A. At this time, the preliminary curing unit 93 that faces the area p1 is also displaced in the main scanning direction Dm together with the print head 8 while radiating ultraviolet rays towards the printing medium A. Accordingly, ejection of ink onto the area p1 and preliminary curing are each carried out once.

After the first printing pass on the area p1 is completed, in accordance with an operating command from the controller 100, the printing unit 6 is displaced in the sub-scanning direction Ds by the displacing amount m of the sub-scanning operation such that the downstream portions of the print head 8 and the preliminary curing unit 93 in the sub-scanning direction Ds, that is, half of the ejection region Ra, overlap with the areas p1 and p2. In such a state, in accordance with an operating command from the controller 100, the printing unit 6 is displaced in the main scanning direction Dm from the right side to the left side of the figure such that a second printing pass is carried out on the area p1 (FIG. 9C). In other words, the print head 8 that faces the areas p1 and p2 is displaced in the main scanning direction Dm while UV ink is ejected towards the printing medium A. At this time, the preliminary curing unit 93 that faces the areas p1 and p2 is also displaced in the main scanning direction Dm together with the print head 8 while radiating ultraviolet rays towards the printing medium A. Accordingly, in the area p1, ejection of ink and preliminary curing are each carried out twice and, in the area p2, ejection of ink and preliminary curing are each carried out once.

Next, in accordance with an operating command from the controller 100, the printing unit 6 is displaced in the sub-scanning direction Ds by the displacing amount m of the sub-scanning operation such that the downstream portions of the print head 8 and the preliminary curing unit 93 in the sub-scanning direction Ds, that is, three third of the ejection region Ra, overlap with the areas p1, p2, and p3. In such a state, in accordance with an operating command from the controller 100, the printing unit 6 is displaced in the main scanning direction Dm from the left side to the right side of the figure such that a third printing pass is carried out on the area p1 (FIG. 9D). In other words, the print head 8 that faces the areas p1, p2, and p3 is displaced in the main scanning direction Dm while UV ink is ejected towards the printing medium A. At this time, the preliminary curing unit 93 that faces the areas p1, p2, and p3 is also displaced in the main scanning direction Dm together with the print head 8 while radiating ultraviolet rays towards the printing medium A. Accordingly, in the area p1, ejection of ink and preliminary curing are each carried out three times, in the area p2, ejection of ink and preliminary curing are each carried out twice and, in the area p3, ejection of ink and preliminary curing are each carried out once.

Furthermore, in accordance with an operating command from the controller 100, the printing unit 6 is displaced in the sub-scanning direction Ds by the displacing amount m of the sub-scanning operation such that the entire region Ra of the print head 8 and the preliminary curing unit 93 in the sub-scanning direction Ds overlaps with the areas p1, p2, p3, and p4. In such a state, in accordance with an operating command from the controller 100, the printing unit 6 is displaced in the main scanning direction Dm from the right side to the left side of the figure such that a fourth printing pass is carried out on the area p1 (FIG. 9E). In other words, the print head 8 that faces the areas p1, p2, p3, and p4 is displaced in the main scanning direction Dm while UV ink is ejected towards the printing medium A. At this time, the preliminary curing unit 93 that faces the areas p1, p2, p3, and p4 is also displaced in the main scanning direction Dm together with the print head 8 while radiating ultraviolet rays towards the printing medium A. Accordingly, in the area p1, ejection of ink and preliminary curing are each carried out four times, in the area p2, ejection of ink and preliminary curing are each carried out three times, in the area p3, ejection of ink and preliminary curing are each carried out twice and, in area p4, ejection of ink and preliminary curing are each carried out once.

As described above, by carrying out the printing passes on the area p1 of the printing medium A for four times, ejection of ink with the print head 8 and preliminary curing with the preliminary curing unit 93 are completed. Furthermore, the full curing unit 94 successively carries out full curing of the area p1. Note that in the present exemplary embodiment, the full curing unit 94 is displaced in the main scanning direction Dm together with the print head 8 in an integrated manner. Furthermore, the length of the irradiation region Rb of the full curing unit 94 in the sub-scanning direction Ds is half the length of the ejection region Ra of the print head 8. Accordingly, as described above, the repeated number of irradiations carried out by the full curing unit 94 to the printing medium A is half the number of the printing passes (twice in this case). Still referring to FIG. 9, the description will be given below.

After the four printing passes is completed on the area p1 of the printing medium A, next, in accordance with an operating command from the controller 100, the printing unit 6 is displaced in the sub-scanning direction Ds by the displacing amount of the sub-scanning operation such that the downstream portion of the full curing unit 94 in the sub-scanning direction Ds, that is, half of the irradiation region Rb, overlaps with the area p1. In this state, when an operating command is sent from the controller 100, the printing unit 6 is displaced in the main scanning direction Dm from the left side to the right side of the figure such that the full curing unit 94 that faces the area p1 is displaced in the main scanning direction Dm while ultraviolet rays are radiated towards the printing medium A. As a result, a first full cure is carried out on the area p1 (FIG. 9F). Incidentally, at this time, ejection of ink and preliminary curing are repeatedly carried out on the areas p2 to p4.

Next, in accordance with an operating command from the controller 100, the printing unit 6 is displaced in the sub-scanning direction Ds by the displacing amount of the sub-scanning operation such that the entire region Rb of the full curing unit 94 in the sub-scanning direction Ds overlaps with the areas p1 and p2. In this state, when an operating command is sent from the controller 100, the printing unit 6 is displaced in the main scanning direction Dm from the right side to the left side of the figure such that the full curing unit 94 that faces the areas p1 and p2 is displaced in the main scanning direction Dm while ultraviolet rays are radiated towards the printing medium A. As a result, a second full cure is carried out on the area p1 and, further, a first full cure is carried out on the area p2 (FIG. 9G). Incidentally, at this time, ink ejection and preliminary curing are repeatedly carried out on the areas p3 and p4.

The above-described printing operation is repeatedly carried out to the entire area of the printing medium A in the sub-scanning direction Ds; accordingly, printing on the printing medium A is carried out. In the printer 1, the full curing units 94 are arranged upstream in the sub-scanning direction Ds with respect to the print head 8 and the preliminary curing units 93. Furthermore, the print head 8, the preliminary curing units 93, and the full curing units 94 are provided in the printing unit 6 in an integrated manner. Accordingly, as described above, after ejection of ink with the print head 8 and photoirradiation with the preliminary curing units 93 have been completed on a predetermined area p1 of the printing medium, by displacing the printing unit 6 downstream in the sub-scanning direction Ds, photoirradiation can be carried out on the area p1 with the full curing unit 94, for example. At this time, the print head 8 and the preliminary curing unit 93 are also displaced downstream in the sub-scanning direction Ds together with the full curing unit 94 in an integrated manner; accordingly, ejection of ink and preliminary curing can be carried out on the following downstream areas p2 to p4. Accordingly, printing can be carried out on the printing medium A in a continuous and efficient manner.

Incidentally, as already been described, in the printer 1, the number of irradiations that is repeatedly carried out by the preliminary curing units 93 and the full curing units 94 increases in accordance with the increase in the number of printing passes. As a result, the manner in which the UV ink is cured may be dependent on the number of printing passes and the image quality of the printed image may disadvantageously change. Accordingly, the applicants have conducted an experiment to find out an appropriate irradiation form of the preliminary curing units 93 and the full curing units 94 and, thus, have obtained a knowledge of an appropriate control method when carrying out irradiation of the preliminary curing units 93 and the full curing units 94 in a stepwise manner.

The UV ink used in the experiment described above contained 40% of 2-(2-vinyloxyethoxy) ethyl acrylate (trade name; VEEA, manufactured by Nippon Shokubai) and 45.5% of phenoxyethyl acrylate (trade name; VISCOAT#192, PEA, manufactured by OSAMA ORGANIC CHEMICAL INDUSTRY) as polymerizable compounds, 6% of IRGACURE 819 (trade name, manufactured by BASF) and 6% of DAROCUR TPO (trade name, manufactured by BASF) as photoinitiators, 0.2% of Solsperse 36000 (trade name, manufactured by LUBRIZOL) as a dispersant, 0.1% of BYK-UV3500 (trade name, manufactured by BYK) as a leveling agent, 0.2% of MEHQ (trade name, manufactured by KANTO CHEMICAL) as a polymerization inhibitor, and 2% of pigment.

Four ink colors, namely, yellow, magenta, cyan, and black were used, printing was carried out by a patterned-four-color mixture (duty of each color; 30%), and the weight of the ink was 1-2 mg/cm$^2$. The nozzle was arranged with a nozzle density of 720 nozzles/2 inches and the ink ejection frequency was 10.8 kHz. Furthermore, the moving speed of the printing unit 6 in the main scanning direction Dm was 300 cps (about 76 cm/s). The displacing amounts m of the sub-scanning operation of the print processing unit 5 in the sub-scanning direction Ds were, when the numbers of printing passes were 4, 6, 8, and 12, ½ inch (about 13 mm)/pass, ⅓ inch (about 8.5 mm)/pass, ¼ inch (about 6.5 mm)/pass, ⅙ inch (about 4 mm)/pass, respectively.

Hereinafter, an appropriate control method of the preliminary curing units 93 and the full curing units 94 will be described from various viewpoints while showing the experimental results. FIGS. 10A to 10C are diagrams each illustrating an irradiation condition for setting glossiness to a predetermined value. More specifically, FIGS. 10A to 10C illustrate the conditions for setting the glossiness of each printed image to 60, 78, and 35. Note that the glossiness was measured at an angle of 45° using VG7000 manufactured by NIPPON DENSHOKU INDUSTRIES. In the subsequent description, a "first integrated quantity of light" refers to an integrated quantity of ultraviolet rays per unit area that has been radiated on the recording medium A with the preliminary curing units 93 while the preliminary curing units 93 were displaced in the main scanning direction Dm for a certain number of times in accordance with the number of printing passes (for example, in the operation example of FIG. 9, four times, which is the same number of times as that of the printing passes). The first integrated quantity of light has a dimension of energy per unit area (mJ/cm$^2$). Similarly, a "second integrated quantity of light" refers to an integrated quantity of ultraviolet rays per unit area that has been radiated on the recording medium A with the full curing units 94 while the full curing units 94 are displaced in the main scanning direction Dm for a certain number of times in accordance with the number of printing passes (for example, in the operation example of FIG. 9, two times, which is half the number of the printing passes). The second integrated quantity of light has a dimension of energy per unit area (mJ/cm$^2$).

For example, referring to FIG. 10A, it can be understood that the glossiness of the printed image can be maintained at 60 by reducing the first integrated quantity of light and increasing the second integrated quantity of light as the numbers of printing passes increase from 4 to 6, 8, and 12. This tendency applies in a similar manner to when the glossiness is set to another value such as, for example, 78 (FIG. 10B) or 35 (FIG. 10C). From the above-described result, the applicants have found that in order to effectively stabilize the image quality of the printed image regardless of the number of printing passes and, in particular, from the viewpoint of stabilizing the glossiness of the printed image, the first integrated quantity of light can be reduced and the second integrated quantity of light can be increased in accordance with the increase in the number of printing passes.

Furthermore, as shown in each of FIGS. 10A to 10C, in order to reduce the first integrated quantity of light in accordance with the increase in the number of printing passes, regardless of the number of printing passes, the duty ratios Du had been gradually reduced while the illuminance (amplitude Am in FIG. 7) of the preliminary curing units 93 had been kept the same. On the other hand, in order to increase the second integrated quantity of light in accordance with the increase in the number of printing passes, regardless of the number of printing passes, the duty ratios Du had been gradually reduced while the illuminance of the full curing units 94 had been kept the same. Moreover, as described below, regardless of the number of printing passes, further stability of the image quality has been pursued by stabilizing a total integrated quantity of light, which is the sum of the first integrated quantity of light and the second integrated quantity of light.

Accordingly, the applicants have further obtained a new knowledge of a method of proactively controlling the image quality of the printed image from the viewpoint of glossiness. As describe above, regardless of the number of printing pass, in order to stabilize the glossiness of the printed image, the first integrated quantity of light and the second integrated quantity of light can be appropriately controlled; however, between the first integrated quantity of light and the second integrated quantity of light, it has been found that the first integrated quantity of light has a lager effect to the glossiness of the image. FIG. 11 is a diagram illustrating the glossiness when the first integrated quantity of light was changed. More specifically, FIG. 11 shows the glossiness of the printed image when the first integrated quantity of light was changed under the following conditions. The illuminance of the ultraviolet rays radiated by the preliminary curing units 93 was 300 mW/cm$^2$, the illuminance of the ultraviolet rays radiated by the full curing units 94 was 750 mW/cm$^2$, and the second integrated quantity of light was 150 mJ/cm$^2$ or higher.

It has been found from the experimental results that, when the number of printing passes is not changed, the glossiness tends to become lower as the first integrated quantity of light increases, and the glossiness tends to become higher as the first integrated quantity of light decreases. Application of these tendencies will allow active control of the glossiness, such as, for example, finishing the printed image to have a mat tone with low glossiness by increasing the first integrated quantity of light, or, on the other hand, finishing the printed image to have high glossiness by reducing the first integrated quantity of light.

Furthermore, in FIG. 11, cases where there were bleeding in the printed image are framed with a thick line. As it is apparent from the results, bleeding tends to occur in the printed image when the first integrated quantity of light is small. In other words, it has been found that occurrence of bleeding can be suppressed by controlling the first integrated quantity of light to a predetermined value or larger. The results show that among the ultraviolet rays radiated on the UV ink, the integrated quantity of the initial irradiation, in other words, among the preliminary curing units 93 and the full curing units 94, the first integrated quantity of light of the preliminary curing units 93 that irradiates ultraviolet rays first, is an important physical quantity to suppress bleeding in the printed image. Note that under the conditions of the experiment, regardless of the number of printing passes, bleeding in the printed image was suppressed by setting the first integrated quantity of light to 50 mJ/cm$^2$ or higher.

Incidentally, it is important to stabilize the quality of the printed image from the aspects of suppressing yellowing that can occur in the printed image and obtaining sufficient film strength of the printed image. FIG. 12 is a diagram illustrating the yellowing statuses and the states of the film strength when the total integrated quantity of light was changed. It has been found from the results shown in FIG. 12 that yellowing of the printed image tends to become more likely to occur when the total integrated quantity of light, which is the sum of the first integrated quantity of light and the second integrated quantity of light, becomes larger. Furthermore, it has been found that the film strength of the printed image tends to become more insufficient when the total integrated quantity of light becomes smaller. These tendencies can be seen in a similar manner in either number of printing passes.

In other words, in order to suppress yellowing of the printed image, regardless of the number of printing passes, the total integrated quantity of light is to be set at a predetermined value or lower. Furthermore, in order to obtain sufficient film strength of the printed image, regardless of the number of printing passes, the total integrated quantity of light is to be set at a predetermined value or higher. Furthermore, these knowledge can be applied to suppress yellowing and to obtain film strength at the same time by controlling the total integrated quantity of light to be within a predetermined range. In particular, the present experimental results have reviled that, regardless of the number of printing passes, by maintaining the total integrated quantity of light within the region of about 180 to about 240 mJ/cm$^2$, preferably to about 210 mJ/cm$^2$, both suppression of yellowing and acquisition of film strength can be achieved.

Furthermore, by making the adhesiveness of UV ink with respect to the printing medium A satisfactory, stabilization of the image quality can be achieved. By studying the present experimental results, the applicants have obtained a knowledge that the adhesiveness of UV ink is greatly affected by, in particular, the illuminance of the ultraviolet rays that are radiated by the preliminary curing units 93. FIG. 13 is a diagram illustrating the states of adhesion when the illuminance of the preliminary curing units was changed. More specifically, FIG. 13 shows the adhesiveness of UV ink when the illuminance of the ultraviolet rays radiated by the preliminary curing units 93 was changed under the following conditions. The illuminance of the ultraviolet rays radiated by the full curing units 94 was 750 mW/cm$^2$, the first integrated quantity of light was 80 mJ/cm$^2$ or higher, and the second integrated quantity of light was 150 mJ/cm$^2$ or higher.

As it is apparent from FIG. 13, the adhesiveness of UV ink has a tendency of worsening as the illuminance of the preliminary curing units 93 becomes smaller. This tendency can be seen in a similar manner in either number of printing passes. Accordingly, regardless of the number of printing passes, the adhesiveness of UV ink with respect to the printing medium A can be improved by controlling the illuminance of the ultraviolet rays radiated on the recording medium A by the preliminary curing units 93 to a predetermined value of higher. In particular, the adhesiveness of UV ink showed improvements in the present experimental results regardless of the number of printing passes when the illuminance of the preliminary curing units 93 were set to about 250 mW/cm$^2$ or higher, and the adhesiveness of UV ink was preferable when set to about 300 mW/cm$^2$ or higher.

As described above, the present exemplary embodiment is configured to control the integrated quantity of light per unit area (first integrated quantity of light) that is radiated on the printing medium A by the preliminary curing units 93 and is configured to control the integrated quantity of light per unit area (second integrated quantity of light) that is radiated on the printing medium A by the full curing units 94, and by reducing the first integrated quantity of light and increasing the second integrated quantity of light in accordance with the increase in the number of printing passes, the image quality of the printed image can be efficiently stabilized regardless of the number of printing passes. This kind of control is effective in particular from the aspect of stabilizing the glossiness of the printed image.

Furthermore, regardless of the number of printing passes, yellowing of the printed image was suppressed by setting the total integrated quantity of light, which is the sum of the first integrated quantity of light and the second integrated quantity of light, to a predetermined value or under. Furthermore, regardless of the number of printing passes, the film strength of the printed image was sufficiently obtained by setting the total integrated quantity of light to a predetermined value or larger. Furthermore, regardless of the number of printing passes, suppression of yellowing and acquisition of film strength were both achieved at the same time by setting the total integrated quantity of light within a predetermined range.

Furthermore, regardless of the number of printing passes, occurrence of bleeding in the printed image was suppressed by controlling the first integrated quantity of light to a predetermined value or larger.

Furthermore, regardless of the number of printing passes, the adhesiveness of UV ink with respect to the printing medium A was increased by controlling the irradiation intensity (illuminance) of the ultraviolet rays radiated on the printing medium A by the preliminary curing units 93 to a predetermined value or larger.

As described above, in the exemplary embodiment, UV ink corresponds to "liquid" of the invention, ultraviolet rays corresponds to "light" of the invention, the preliminary curing unit 93 corresponds to a "first irradiation unit" of the invention, the full curing unit 94 corresponds to a "second irradiation unit" of the invention, the controller 100 corresponds to a "controller" and a "pass number setting unit" of the invention, and the sub-scanning drive mechanism 43 corresponds to a "drive mechanism" of the invention.

Note that the invention is not limited to the exemplary embodiment described above and the elements of the exemplary embodiment described above may be appropriately combined or various modifications may be made as long as they do not depart from the spirit of the invention.

For example, in the exemplary embodiment described above, the length of the ejection region Ra of the print head 8 and the length of the irradiation region Ra of the preliminary curing units 93 are the same in the sub-scanning direction Ds. However, if the width of the area, in the sub-scanning direction Ds, in which the preliminary curing units 93 irradiate ultraviolet rays is larger than the displacing amount m of the sub-scanning operation, then, the length of the ejection region Ra of the print head 8 and the length of the irradiation region Ra of the preliminary curing units 93 do not necessarily have to be the same as described above.

Furthermore, in the exemplary embodiment described above, the length of the irradiation region Rb of each full curing unit 94 is half the length of the ejection region Ra of the print head 8 in the sub-scanning direction Ds. However, these relationships are not requirements of the invention and can be changed as appropriate.

Furthermore, in the exemplary embodiment described above, the print head 8, the preliminary curing units 93, and the full curing units 94 are configured in an integrated manner such that when the print head 8 carries out a printing pass, the preliminary curing units 93 and the full curing units 94 are displaced in the main scanning direction Dm together with the print head 8. However, the preliminary curing units 93 and the full curing units 94 can be constituted as a different body from the print head 8. Furthermore, the full curing unit 94 does not necessarily have to irradiate ultraviolet rays while being displaced in the main scanning direction Dm and may carry out irradiation of ultraviolet rays on the entire area of the printing medium A in the main scanning direction Dm all at once, for example.

Furthermore, in the exemplary embodiment described above, the irradiation states of the preliminary curing units 93 and the full curing units 94 are controlled with the amplitude Am of the square wave pulse current and with the duty ratio Du. However, the square wave pulse current does not necessarily have to be used to control the irradiation states of the preliminary curing units 93 and the full curing units 94. In other words, appropriate control forms may be appropriately adopted to control the illuminance of the ultraviolet rays and the irradiation period.

Furthermore, liquid other than UV ink may be ejected from the print head 8, and the light radiated from the preliminary curing units 93 and the full curing units 94 may be appropriately changed in accordance with the type of liquid ejected from the print head 8.

The entire disclosure of Japanese Patent Application No. 2013-068277, filed Mar. 28, 2013 is expressly incorporated by reference herein.

What is claimed is:

1. A printing apparatus, comprising:

a print head that performs a printing pass that ejects a photocurable liquid onto a printing medium while being displaced in a main scanning direction each time the print head is displaced in a sub-scanning direction by a displacing amount of a sub-scanning operation, the sub-scanning direction intersecting the main scanning direction;

a first irradiation unit that follows the print head displaced in the main scanning direction while radiating light that cures the liquid;

a second irradiation unit that irradiates the light towards an area where irradiation of the light has been completed by the first irradiation unit, wherein the second irradiation unit is arranged in the sub-scanning direction with respect to the first irradiation unit;

a controller that controls a first integrated quantity of light that is an integrated quantity of the light per unit area radiated on the printing medium by the first irradiation unit and that controls a second integrated quantity of light that is an integrated quantity of the light per unit area radiated on the printing medium by the second irradiation unit; and a pass number setting unit that can set the number of printing passes that is performed from a plurality of numbers, wherein the controller reduces the first integrated quantity of light and increases the second integrated quantity of light in accordance with an increase in the number of printing passes that is performed and that is set by the pass number setting unit.

2. The printing apparatus according to claim 1, wherein the controller controls a total integrated quantity of light to be within a predetermined range regardless of the number of printing passes that is performed, the total integrated quantity of light being a sum of the first integrated quantity of light and the second integrated quantity of light.

3. The printing apparatus according to claim 1, wherein the controller controls the first integrated quantity of light to become a predetermined value or larger regardless of the number of printing passes that is performed.

4. The printing apparatus according to claim 1, wherein the controller controls an irradiation intensity of the light that is radiated by the first irradiation unit to become a predetermined value or larger regardless of the number of printing passes that is performed.

5. The printing apparatus according to claim 1, wherein the controller flashes a light source of the first irradiation unit and a light source of the second irradiation unit such that each light source is turned on and off alternately to control an irradiation state of the light from the first irradiation unit and an irradiation state of the light from the second irradiation unit and controls a ratio between a lighting duration of each light source and a no-light duration of each light source to control the first integrated quantity of light and the second integrated quantity of light.

6. The printing apparatus according to claim 1, wherein an irradiation intensity of the second irradiation unit is higher than an irradiation intensity of the first irradiation unit.

7. The printing apparatus according to claim 1, wherein the second irradiation unit is provided upstream in the sub-scanning direction with respect to the print head and the first irradiation unit, and a drive mechanism is further included that displaces the print head, the first irradiation unit, and the second irradiation unit downstream in the sub-scanning direction in an integrated manner.

8. A method of printing, comprising:

performing a printing pass that displaces a print head towards a main scanning direction while the print head ejects a photocurable liquid onto a printing medium each time the print head is displaced in a sub-scanning direction by a displacing amount of a sub-scanning operation, the sub-scanning direction intersecting the main scanning direction;

radiating light that cures the liquid while a first irradiation unit follows the print head, the print head being displaced in the main scanning direction, in the main scanning direction;

radiating light with a second irradiation unit towards an area where irradiation of light with the first irradiation unit has been completed, wherein the second irradiation unit is arranged in the sub-scanning direction relative to the first irradiation unit;

setting the number of printing passes that is performed from a plurality of numbers; and reducing a first integrated quantity of light that is an integrated quantity of the light per unit area that is radiated on the printing medium by the first irradiation unit and increasing a second integrated quantity of light that is an integrated quantity of the light per unit area that is radiated on the printing medium by the second irradiation unit, in accordance with the set number of printing passes that is performed.

* * * * *